United States Patent [19]

Wallner et al.

[11] Patent Number: 4,486,067

[45] Date of Patent: Dec. 4, 1984

[54] FUSE HOLDER, ESPECIALLY FUSE HOLDER FOR MINIATURIZED FUSES

[75] Inventors: Peter Wallner, Kriens; Alois Lindenmann, Lucerne, both of Switzerland

[73] Assignee: Schurter AG, Lucerne, Switzerland

[21] Appl. No.: 439,882

[22] Filed: Nov. 8, 1982

[30] Foreign Application Priority Data

Nov. 25, 1981 [CH] Switzerland ..... 7532/81

[51] Int. Cl.[3] ..... H01R 3/00; H01R 4/54

[52] U.S. Cl. ..... 339/218 R; 339/90 F; 339/147 R; 339/181 R; 339/275 R; 29/878; 29/884

[58] Field of Search ..... 337/187, 195, 201; 339/90 F, 147 R, 181 R, 181 C, 256 C, 256 S, 258 RR, 258 TC, 218 R, 218 C, 275 R; 156/73.1; 264/23, 248, 268; 29/876, 877, 878, 884

[56] References Cited

U.S. PATENT DOCUMENTS 4,045,114 8/1977 Dechelette ..... 29/884 X
4,301,343 11/1981 Jonelis ..... 264/23 X

FOREIGN PATENT DOCUMENTS 1490920 11/1977 United Kingdom .

*Primary Examiner*—Eugene F. Desmond
*Assistant Examiner*—Steven C. Bishop
*Attorney, Agent, or Firm*—Werner W. Kleeman

[57] ABSTRACT

The fuse holder comprises a socket member composed of two thermoplastic members joined by ultrasonic welding with formation of a solder-tight welding joint or seam. Contact members disposed within the socket member extend to the exterior and include sealing members or locations which are sealingly enclosed in the welding joint. A lateral contact of these contact members is connected electrically to the connection conductor of a head member made of synthetic material by a bayonet joint and a spring is provided to supply the engagement pressure effective at the fuse.

17 Claims, 5 Drawing Figures

FUSE HOLDER, ESPECIALLY FUSE HOLDER FOR MINIATURIZED FUSES

BACKGROUND OF THE INVENTION

The present invention relates to a new and improved construction of a fuse holder, especially a fuse holder for miniaturized fuses.

Generally speaking, the fuse holder of the present development is of the type comprising a substantially tubular-shaped socket member made of an electrically insulating material, and a base contact member as well as a lateral contact member are disposed within said socket member. In such a fuse holder the base contact member and the lateral contact member are each electrically connected to a respective terminal, and the terminals extend to the exterior of the socket member. There is further provided a head member made of electrically insulating material which is designed to accommodate one end of the fuse when inserted therein and a conductor member which is adapted to be contacted by the aforementioned one end of the fuse in an electrically conducting manner.

Fuse holders of the aforementioned type are increasingly frequently soldered, for example to printed circuit boards, which requires particular measures to prevent any damage caused by the soldering agent including flux agents and so forth.

Prior Art fuse holders as described, for example, in German Patent Publication No. 2,044,324 or German Gebrauchsmuster No. 8,020,260 are not sealed against soldering agents.

A known water-proof fuse holder as for example disclosed in British Pat. No. 1,490,920 is composed of many parts so that the assembly becomes expensive. Due to screw couplings the electrical connection is not good, and thus there is present a higher resistance. The fuse holder tends to become porous and untight at the metal-to-plastics transition regions. The plastics material absorbs humidity and desorbs the same, resulting in swelling and shrinkage, so that loosening will occur in the transition regions.

SUMMARY OF THE INVENTION

Therefore, with the foregoing in mind it is a primary object of the present invention to provide a new and improved construction of a fuse holder which is not associated with the aforementioned limitations and drawbacks of the prior art constructions.

Another and more specific object of the present invention aims at providing an economically advantageously fabricatable, yet still mechanically and electrically high-grade fuse holder which does not exhibit the aforementioned drawbacks, and furthermore, is designed to accommodate miniaturized fuses.

Still a further significant object of the present invention is directed to a new and improved construction of a fuse holder which may be readily combined with printed circuits by any one of the known soldering processes, in particular in such a way that the interior of the fuse holder is protected against entry of any of the agents utilized in the soldering process.

Now in order to implement these and still further objects of the invention, which will become more readily apparent as the description proceeds, the fuse holder of the present development is manifested by the features that, the socket member at its connection side is made of a synthetic material and is structured so as to be solder-tight.

The socket member of the fuse holder according to the invention can be structured so as to be sealed against the entry of soldering agent into the interior thereof. Alternatively, the socket member of the fuse holder according to the invention can be structured so as to be sealed against wave soldering.

While there exist a number of ways to achieve the required sealing action against soldering, a particularly economical way is suggested for in providing a specific design of the fuse holder according to the invention. More specifically, the socket member comprises two parts, each made of a thermoplastic synthetic material, and the two parts are welded ultrasonically with the formation of a welding joint into which the terminals are sealingly enclosed and extend from the interior to the exterior.

In a specifically preferred design there is provided a first part forming an exterior sleeve arranged about an axis and into which there is axially inserted a second part forming an oversized base or bottom member, both said parts being interconnected by ultrasonic welding. Such design not only has the advantage that the respective parts may be assembled with a high degree of precision and may be welded by ultrasonic energy in a very simple manner, but also this construction enables the parts as such to be very simply manufactured and assembled.

In the aforementioned design the base or bottom member can form a support for the contact members and the terminals so that these electrically conductive members can be mounted at the bottom member which then can be assembled along with the contact members and the terminals in the sleeve member.

Consequently the unique possibility exists during the ultrasonic welding of the socket parts of tightly forming the terminals in the welding joint in the same operational step.

Specifically, in respect of the base contact member which extends predominantly transversely with respect to the sleeve axis, the possibility exists of employing a sealing member which extends at least approximately normally to the sleeve axis and which includes a constriction. Consequently, a particularly tight seal is achieved in which the actual sealing location remains practically free of mechanical effects in case forces act upon the exterior terminal and/or the base contact member. This is favorably affected by the outwardly extending part of the terminal which is predominantly in a position which is parallel to the sleeve axis. This also provides a narrow pressure zones preferred in ultrasonic welding which, in this case, are advantageously attained by an axial overdimension or ovesize.

Since an inclined position of the lateral contact member is not intended solely for reasons of space, the sealing member associated with the respective terminal can extend at an acute angle with respect to the sleeve axis. Ultrasonic welding thereof is assisted by roughening the surface, for instance by embossing or stamping. Also in this case, a part of the terminal which is bent-off and extends towards the exterior from the sealing member in parallellism with respect to the sleeve axis favorably affects the relief of the sealing location from mechanical loads. By appropriate shaping relief from loads also may be obtained with respect to the interior, which may be important during use of the fuse holder to prevent the soldered joint from becoming loaded.

For obtaining a shape having an axial oversize or overdimension particularly favorable for ultrasonic welding, it is suggested to provide rib or web-like projections at least over the greatest portion of the surfaces of the socket members which later contact each other. Such projections may be at least partially omitted at the locations where the terminals pass through.

To additionally and further anchor the terminals and/or displace material into the welding joint the connecting member may be provided with serrations close to the sealing location.

Various combinations of the aforementioned sealing measures can be advantageously employed.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
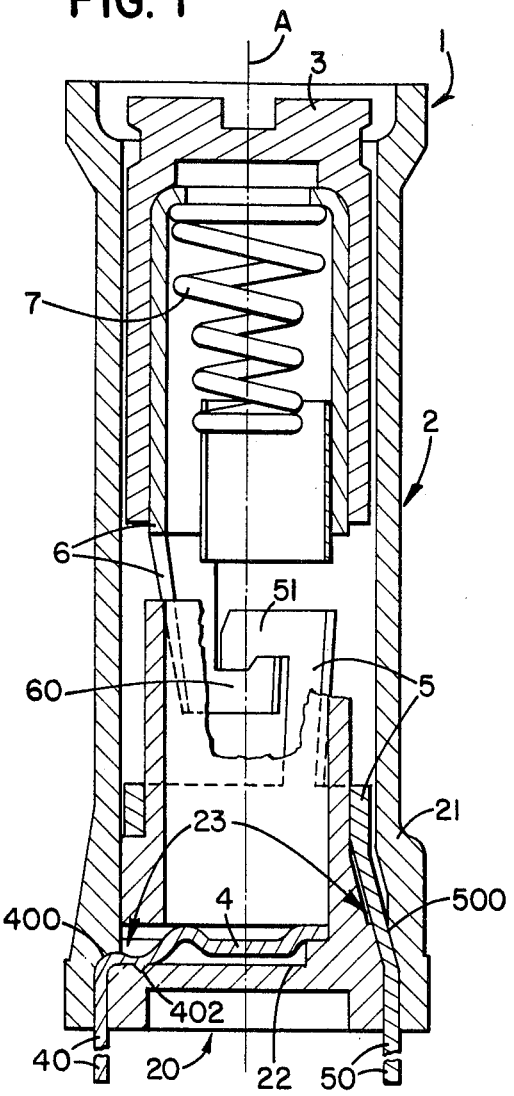
FIG. 1 is an axial sectional view through a fuse holder according to the invention and without the fuse inserted.
Figure 2:
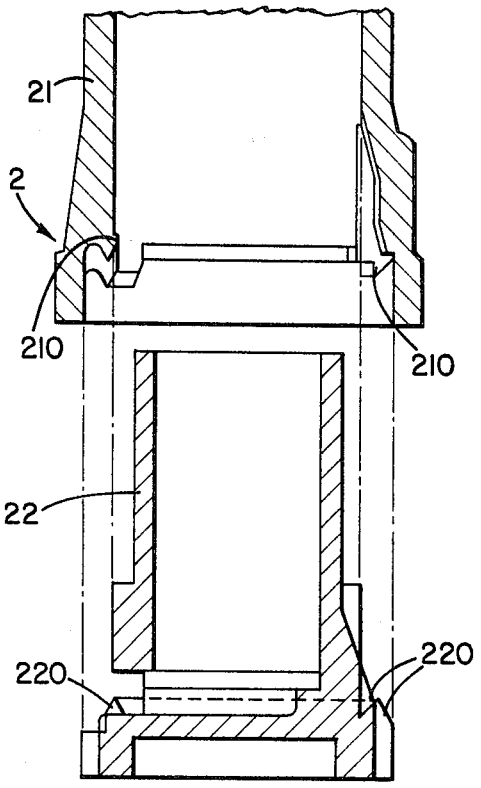
FIG. 2 is a sectional view similar to that shown in FIG. 1, through part of the connecting end of a sleeve and through a separate base or bottom member of the socket member accommodated thereto of the fuse holder shown in FIG. 1.
Figure 5:
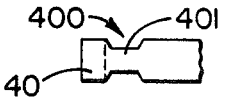
FIG. 5 is a top plan view of the sealing member for the terminal associated with the base contact member and depicted on a scale different from that shown in FIG. 3.
Figure 3:
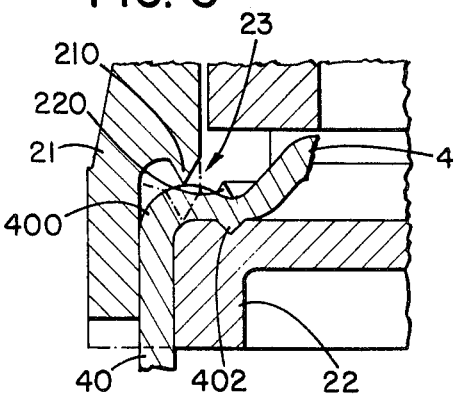
FIG. 3 is an enlarged fragmentary illustration of the sealing location at the terminal of the base contact member of the fuse holder shown in FIG. 1 prior to assembly.
Figure 4:
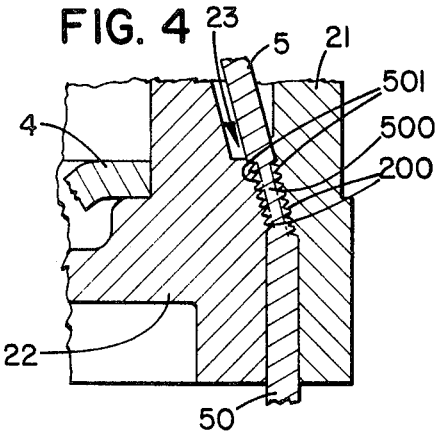
FIG. 4 is an enlarged fragmentary illustration of the sealing passage through the welding joint of the sealing member in the terminal associated with the lateral contact member of the fuse holder shown in FIG. 1.

With reference now to FIG. 1 of the drawings, the exemplary embodiment of fuse holder 1 will be seen to comprise a socket member 2 and a head member 3 inserted therein. Within the socket member 2 there is provided a base contact member 4 which has a terminal 40 extending towards the exterior at the connecting side 20 of the fuse holder 1. Also, a lateral contact member 5 is provided in the socket member 2, and a terminal 50 is passed-through to extend outwardly at the connecting side 20 of the fuse holder 1. The socket member 2 comprises a sleeve 21 arranged about an axis A, the fuse lengthwise axis, and a base or bottom member 22 welded to the sleeve 21 in the interior thereof by ultrasonic energy. The sealing locations 400 and 500 of the terminals 40 and 50, respectively, are embedded in the related welding joint 23, the welding joint 23 being evident in the drawings of FIGS. 1, 3 and 4 only at the region of the sealing locations or members 400 and 500. To obtain an optimal ultrasonic welding seam or joint axially projecting oversize ribs or rib members 210 and 220 are provided at the sleeve 21 and at the base or bottom member 22, respectively. The rib 210 as it exists prior to ultrasonic welding is shown in full lines in FIG. 3. The hypothetical position of the rib 210, assuming that it would not melt during ultrasonic welding, is illustrated by an axially displaced dash-and-dot line. The final position as assumed after ultrasonic welding is shown in FIG. 1. In accordance with FIG. 3, therefore, the rib 210 must be totally displaced and must be molten during the ultrasonic welding; thus, the material exactly flows around and encloses the constriction 401 (FIG. 5) of the sealing location or member 400. Thus, not only the sealing of the thermoplastic members 21 and 22 including the counter rib 220 is due to the rib 210, but also the seal at the sealing location or member 400 (FIG. 3). As will be evident from FIG. 4, the sealing member or location 500 has a roughened stamped or embossed surface. Those components or parts 200 of the members 21 and 22 which melt during ultrasonic welding and which are partially displaced to form part of the welding joint or seam 23 which is also shown in FIGS. 1 and 3, have been indicated by dash-and-dot lines.

In FIGS. 1 and 3 a spiked prong 402 of the terminal 40 will be recognized which serves for retaining purposes, on the one hand, and assists in the ultrasonic welding process, on the other hand.

It will be seen that in this way at the connecting side 20 of the fuse holder 1 there is obtained a structure which is at least sealed against the entry of soldering agent or, respectively, against wave soldering. In this structure the members 21 and 22 can be obtained in a most simple manner. Also, the metal members or parts 4 and 40 as well as 5 and 50 can be produced by simple operations. The metal members 4 and 40 as well as 5 and 50 can be slipped into the base or bottom member 22 which, then, is inserted into the sleeve 21; subsequently the bottom member 22 is pushed inwardly from the position shown in FIG. 3 into the position shown in FIG. 1, with simultaneous application of ultrasonic energy and with the formation of the welding seam joint 23. The socket member 2 is thus produced.

In accordance with the showing of FIG. 1, the lateral contact member 5 of the socket member 2 is provided with hook-like bayonet portions 51 into which engage hook-like bayonet portions 60 of a connection conductor 6, this connection conductor 6 being made solid with the head or head member 3 formed of synthetic material in conventional manner.

A miniature fuse forming a small tube with a metal cap at each end which are connected by a fusable conductor is inserted into the connection conductor 6 while the head or head member 3 is located outside of the socket member 2. Upon insertion of the head 3 into the socket member 2 the other end of the fuse is urged against the base contact member 4 and the spring 7 of the head or head member 3 is compressed. The bayonet portions 51 and 60 thus are interengaged. This state of the fuse holder 1 is shown in FIG. 1 with the fuse absent.

Thermoplastic materials having as high a thermal resistance as possible while being sufficiently suited for ultrasonic welding are particularly appropriate as materials from which the parts of the socket member are formed. Therefore, by way of example, some commercially available polyesters for electrotechnical purposes as well as polybutylene terephthalate and polycarbonates are well suited.

While there are shown and described present preferred embodiments of the invention, it is to be distinctly understood that the invention is not limited thereto, but may be otherwise variously embodied and practiced within the scope of the following claims. Accordingly,

What we claim is:

1. A fuse holder for the insertion of a fuse having two ends, said fuse holder comprising:

a substantially tube-like socket member made of electrically insulating material;

two contact members disposed within said socket member, each of said two contact members being arranged to form an electric contact with a respective one of said two ends of said fuse when inserted into said fuse holder;

said two contact members each being in electrical connection to a respective terminal projecting outside said socket member;

a head member made of electrically insulating material designed to accommodate said fuse;

said socket member being made of a synthetic material and being structured so as to be solder-tight;

said socket member comprising two parts made of a thermoplastic synthetic material;

said two parts being welded ultrasonically with the formation of a welding joint into which the terminals are sealingly embedded;

a first of said two parts forming an exterior sleeve having an axis; and a second of said two parts forming an oversized bottom member adapted to be axially inserted and ultrasonically welded to said first part.

2. The fuse holder as defined in claim 1, wherein:

said two contact members are supported at said bottom member and said sleeve, respectively;

said terminals are each connected to a respective one of said contact members; and said terminals each comprise a respective sealing member which is embedded in said welding joint.

3. The fuse holder as defined in claim 2, wherein:

said sealing members are located at a portion of the welding joint which extends at an angle relative to the sleeve axis.

4. The fuse holder as defined in claim 2, wherein:

a first one of said sealing members has a constriction which is embedded in the welding joint; and said first sealing member and an associated portion of said welding joint lie in a plane which extends at least approximately normally with respect to the sleeve axis.

5. The fuse holder as defined in claim 4, wherein:

a second one of said sealing members has a roughened surface.

6. The fuse holder as defined in claim 5, wherein:

said welding joint and an associated portion of said second sealing member are located within a plane which extends at an acute angle with respect to the sleeve axis.

7. The fuse holder as defined in claim 6, wherein:

said welding joint includes at least at a largest portion thereof oversized material which originally projected and extending in axial direction from at least one of the two parts of the socket member.

8. A fuse holder for the insertion of a fuse having two ends, said fuse holder comprising:

a substantially tube-like socket member made of electrically insulating material and having two opposed ends;

a base member inserted into one of said ends of said socket member and sealingly welded thereto;

said base member having a first and a second exterior terminal;

a head member made of electrically insulating material and including a conductor member adapted to form an electrical contact with one end of said fuse when inserted therein;

a lateral contact member provided within said socket member and arranged to provide for electrical connection between said conductor member and said second terminal;

a base contact member provided within said socket member and electrically connected to said second terminal;

said base contact member being arranged to form an electric contact with the other one of said ends of said fuse when inserted into said fuse holder; and said socket member being made of a synthetic material and being structured so as to be solder-tight.

9. A fuse holder as defined in claim 8, wherein:

said socket member is structured so as to be sealed against the entry of soldering agent into the interior thereof.

10. The fuse holder as defined in claim 8, wherein:

said socket member is structured so as to be sealed against wave soldering.

11. The fuse holder as defined in claim 8, wherein:

said socket member comprises two parts made of a thermoplastic synthetic material; and said two parts are welded ultrasonically with the formation of a welding joint into which the terminals are sealingly embedded.

12. The fuse holder as defined in claim 11, wherein:

a first of said two parts forms an exterior sleeve having an axis; and a second of said two parts forms an oversized bottom member defining said base member and adapted to be axially inserted and ultrasonically welded to said first part.

13. A fuse holder as defined in claim 12, wherein:

said base contact member and said lateral contact member are supported at said bottom member and at said sleeve, respectively;

said first and said second terminals are electrically connected to said base contact member and said lateral contact member, respectively; and said first and said second terminals each comprise a respective sealing member which is embedded in said welding joint.

14. The fuse holder as defined in claim 13, wherein:

said sealing members are located in a portion of the welding joint which extends at an angle relative to the sleeve axis.

15. The fuse holder as defined in claim 14, wherein:

a first one of said sealing members has a constriction which is embedded in the welding joint; and said first sealing member and an associated portion of said welding joint lie in a plane which extends at least approximately normally with respect to the sleeve axis.

16. A fuse holder for the insertion of a fuse having two ends, said fuse holder comprising:

a substantially tube-like socket member made of electrically insulating, thermoplastic synthetic material;

two contact members disposed within said socket member, each of said two contact members being arranged to form an electric contact with a respective one of said two ends of said fuse when inserted into said fuse holder;

said two contact members each being in electrical connection inside said socket member to a respective terminal;

a head member made of electrically insulating material designed to accommodate said fuse;

said socket member comprises two parts welded ultrasonically to each other with the formation of a solder-tight welding joint embedding the terminals; and said terminals projecting outside said socket member and extending through said solder-tight welding joint formed between said two parts of said socket member.

17. The fuse holder as defined in claim 16, wherein:

said welding joint includes at least at a largest portion thereof oversized material which originally projected and extended in axial direction from at least one of said two parts of said socket member.

* * * * *